US008526868B2

(12) United States Patent
Morihara

(10) Patent No.: US 8,526,868 B2
(45) Date of Patent: Sep. 3, 2013

(54) IMAGE ALIGNMENT ADJUSTING APPARATUS

(75) Inventor: Kazushige Morihara, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 334 days.

(21) Appl. No.: 13/015,859

(22) Filed: Jan. 28, 2011

(65) Prior Publication Data

US 2011/0185933 A1 Aug. 4, 2011

Related U.S. Application Data

(60) Provisional application No. 61/300,158, filed on Feb. 1, 2010, provisional application No. 61/300,166, filed on Feb. 1, 2010.

(51) Int. Cl.
*G03G 15/01* (2006.01)

(52) U.S. Cl.
USPC ..... 399/301; 347/116

(58) Field of Classification Search
USPC ..... 399/301; 347/116
See application file for complete search history.

(56) References Cited

U.S. PATENT DOCUMENTS 7,248,272 B2 * 7/2007 Harada et al. ..... 347/116
7,313,352 B2 12/2007 Shinohara et al.
7,715,770 B2 * 5/2010 Kinoshita ..... 399/301

* cited by examiner

*Primary Examiner* — William J Royer
(74) *Attorney, Agent, or Firm* — Turocy & Watson, LLP

(57) ABSTRACT

According to one embodiment, an image alignment adjusting apparatus includes: an endless traveling belt; a pattern sensor configured to detect an adjustment pattern including plural colors imaged on the traveling belt; and a correcting unit configured to use, in initial adjustment, for image alignment adjustment, an initial adjustment value obtained by detecting a plurality of sets of the adjustment pattern imaged over the entire circumference of the traveling belt and use, in intermediate adjustment, for the image alignment adjustment an intermediate adjustment value obtained by correcting the initial adjustment value using an intermediate detection value obtained by detecting one set of the adjustment pattern imaged on the traveling belt.

21 Claims, 14 Drawing Sheets

IMAGE ALIGNMENT ADJUSTING APPARATUS

CROSS-REFERENCE TO RELATED APPLICATION

This application is based upon and claims the benefit of priority from Provisional U.S. application No. 61/300,158 filed on Feb. 1, 2010 and No. 61/300,166 filed on Feb. 1, 2010, the entire contents of which are incorporated herein by reference.

FIELD

Embodiments described herein relate generally to image alignment in an image forming apparatus that superimposes plural images such as a color copying machine or a MFP (multi-functional peripheral)

BACKGROUND

A color image forming apparatus that superimposes plural images to obtain a color image performs alignment of the plural images, prevents blurs and bleeding of the images, and maintains satisfactory image quality. An image forming apparatus that obtains a color image using a traveling belt images an adjustment pattern for alignment adjustment on the belt and aligns plural images using a detection result obtained by detecting the adjustment pattern. The thickness of the belt varies depending on regions of the belt. Since the image forming apparatus aligns the images taking into account the thickness that varies depending on the regions of the belt, during alignment adjustment, the image forming apparatus images plural adjustment patterns over the entire circumference of the belt. The image forming apparatus averages detection results obtained by detecting the plural adjustment patterns imaged over the entire circumference of the belt. The image forming apparatus aligns the plural images using an average obtained by averaging the detection results to thereby improve accuracy of the alignment.

However, if the image forming apparatus images the plural adjustment patterns over the entire circumference of the belt and obtains an average of the plural adjustment patterns every time the image forming apparatus performs the image alignment adjustment, time required for the image alignment adjustment is long. Therefore, it is likely that the image forming apparatus keeps a user waiting during the image alignment adjustment.

DETAILED DESCRIPTION

In general, according to one embodiment, an image alignment adjusting apparatus includes: an endless traveling belt; a pattern sensor configured to detect an adjustment pattern including plural colors imaged on the traveling belt; and a correcting unit configured to use, in initial adjustment, for image alignment adjustment by an image forming unit configured to image the adjustment pattern, an initial adjustment value obtained by detecting, with the pattern sensor, a plurality of sets of the adjustment pattern imaged over the entire circumference of the traveling belt and use, in intermediate adjustment, for the image alignment adjustment by the image forming unit, an intermediate adjustment value obtained by correcting the initial adjustment value using an intermediate detection value obtained by detecting, with the pattern sensor, one set of the adjustment pattern imaged on the traveling belt.

Embodiments are explained below.

First Embodiment

Figure 1:
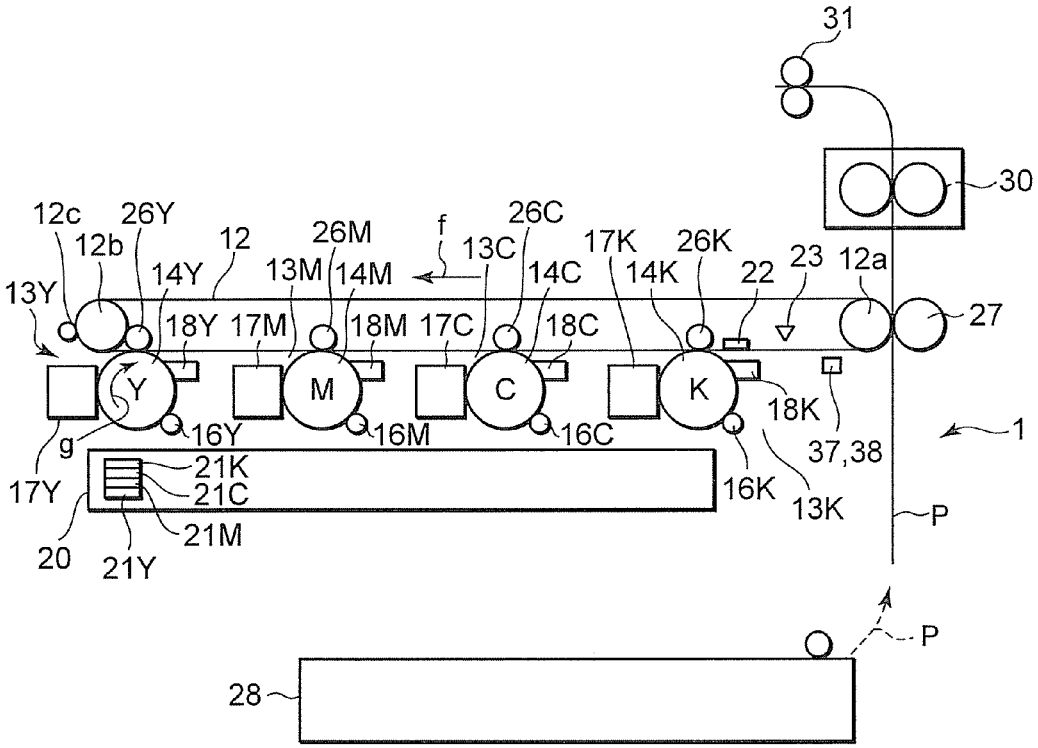
FIG. 1 is a schematic diagram of a main part of a color printer according to a first embodiment.

FIG. 1 is a schematic diagram of a main part of a color printer 1 of a tandem type, which is an image forming apparatus according to a first embodiment. The color printer 1 includes four sets of image forming stations 13K, 13C, 13M, and 13Y arranged in parallel along the lower side of a transfer belt 12, which is an endless traveling belt. The image forming stations 13K, 13C, 13M, and 13Y respectively include photoconductive drums 14K, 14C, 14M, and 14Y. Rotation axes of the photoconductive drums 14K, 14C, 14M, and 14Y are parallel to a direction (a main scanning direction) orthogonal to a traveling direction (a sub-scanning direction) in an arrow f direction of the transfer belt 12. The rotation axes of the photoconductive drums 14K, 14C, 14M, and 14Y are arranged at equal intervals from one another along the sub-scanning direction of the transfer belt 12.

The image forming stations 13K, 13C, 13M, and 13Y respectively include, around the photoconductive drums 14K, 14C, 14M, and 14K which rotate in an arrow g direction, chargers 16K, 16C, 16M, and 16Y, developing devices 17K, 17C, 17M, and 17Y, and photoconductive cleaners 18K, 18C, 18M, and 18Y.

The image forming stations 13K, 13C, 13M, and 13Y respectively include, around the photoconductive drums 14K, 14C, 14M, and 14K, chargers 16K, 16C, 16M, and 16Y, developing devices 17K, 17C, 17M, and 17Y, and photoconductive cleaners 18K, 18C, 18M, and 18Y.

The color printer 1 includes a laser exposing device 20. The laser exposing device 20 and the image forming stations 13K, 13C, 13M, and 13Y configure an image forming unit. The laser exposing device 20 irradiates exposure lights corresponding to the respective colors to sections between the chargers 16K, 16C, 16M, and 16Y and the developing devices 17K, 17C, 17M, and 17Y around the photoconductive drums 14K, 14C, 14M, and 14Y. The laser exposing device 20 forms electrostatic latent images based on image data or data of respective color components of the adjustment patterns on the photoconductive drums 14K, 14C, 14M, and 14Y. The laser exposing device 20 includes laser oscillators 21K, 21C, 21M, and 21Y for the respective color components of black (K), cyan (C), magenta (M), and yellow (Y). The developing devices 17K, 17C, 17M, and 17Y respectively form toner images or adjustment patterns of black (K), cyan (C), magenta (M), and yellow (Y) on the photoconductive drums 14K, 14C, 14M, and 14Y.

The color printer 1 includes a driving roller 12*a* and a driven roller 12*b* configured to support the transfer belt 12. The driving roller 12*a* and the driven roller 12*b* cause the transfer belt 12 to travel in the arrow f direction. The transfer belt 12 includes a belt marker 22 on the inner circumference thereof. The belt marker 22 is formed of a reflection tape that reflects light. The color printer 1 includes, on the inside of the transfer belt 12, a belt sensor 23 configured to detect the belt marker 22.

The color printer 1 includes primary transfer rollers 26K, 26C, 26M, and 26Y respectively in positions opposed to the photoconductive drums 14K, 14C, 14M, and 14Y via the transfer belt 12. The primary transfer rollers 26K, 26C, 26M, and 26Y respectively primarily transfer toner images formed on the photoconductive drums 14K, 14C, 14M, and 14Y to superimpose the toner images one on top of another on the transfer belt 12. The photoconductive cleaners 18K, 18C, 18M, and 18Y respectively remove and collect toners remaining on the photoconductive drums 14K, 14C, 14M, and 14Y after the primary transfer.

The color printer 1 includes a secondary transfer roller 27 in a secondary transfer position opposed to the driving roller 12*a* via the transfer belt 12. The color printer 1 collectively secondarily transfers, in a nip between the transfer belt 12 and the secondary transfer roller 27, the toner images on the transfer belt 12 onto a sheet P fed from a paper feeding unit 28.

The color printer 1 includes a fixing device 30 and a paper discharge roller 31 further downstream than the secondary transfer roller 27 along a conveying direction of the sheet P. The color printer 1 fixes the toner images on the sheet P with the fixing device 30 and discharges the sheet P with the paper discharge roller 31.

The transfer belt 12 includes a belt cleaner 12*c*. The belt cleaner 12*c* removes the adjustment patterns imaged on the transfer belt 12 and the toners remaining on the transfer belt 12 after a print image is secondarily transferred.

When the color printer 1 of the tandem type superimposes plural images one on top of another on the transfer belt 12, a positional shift (a superimposition shift) tends to occur. When the positions of the plural images shift from one another, it is likely that a bleeding image is formed and image quality is deteriorated. As the positional shift of the images, there is, for example, (1) a shift in the main scanning direction (2) a shift in the sub-scanning direction, (3) a shift of image magnifications, or (4) a tilt of the images. The color printer 1 needs to perform alignment adjustment in order to correct the positional shift of the images.

The color printer 1 includes a front pattern sensor 37 and a rear pattern sensor 38 for detecting adjustment patterns imaged on the transfer belt 12 for alignment adjustment. The front pattern sensor 37 and the rear pattern sensor 38 are present around the transfer belt 12 and downstream of the image forming station 13K for black (K). The front pattern sensor 37 detects a front side adjustment pattern formed in a front area that is parallel to a traveling direction of the transfer belt 12. The rear pattern sensor 38 detects a rear side adjustment pattern formed in a rear area that is parallel to the traveling direction of the transfer belt 12.

The color printer 1 calculates, using detection results of the front pattern sensor 37 and the rear pattern sensor 38, an adjustment value for adjusting (1) the shift in the main scanning direction, (2) the shift in the sub-scanning direction, (3) the shift of image magnifications, or (4) the tilt of the images. If the images positionally shift from one another in the main scanning direction or the sub-scanning direction, the color printer 1 calculates a shift of output timings of lasers in the main scanning direction or the sub-scanning direction as the adjustment value and shifts the output timings of the lasers in the main scanning direction or the sub-scanning direction. If the magnifications of the images shift from one another, the color printer 1 calculates shift amounts of clock speeds of the lasers as the adjustment value and shifts clock frequencies of the lasers. If the images tilt, the color printer 1 calculates shift amounts of the tilts as the adjustment value and shifts the tilt of a tilt mirror of an optical system.

Figure 2:
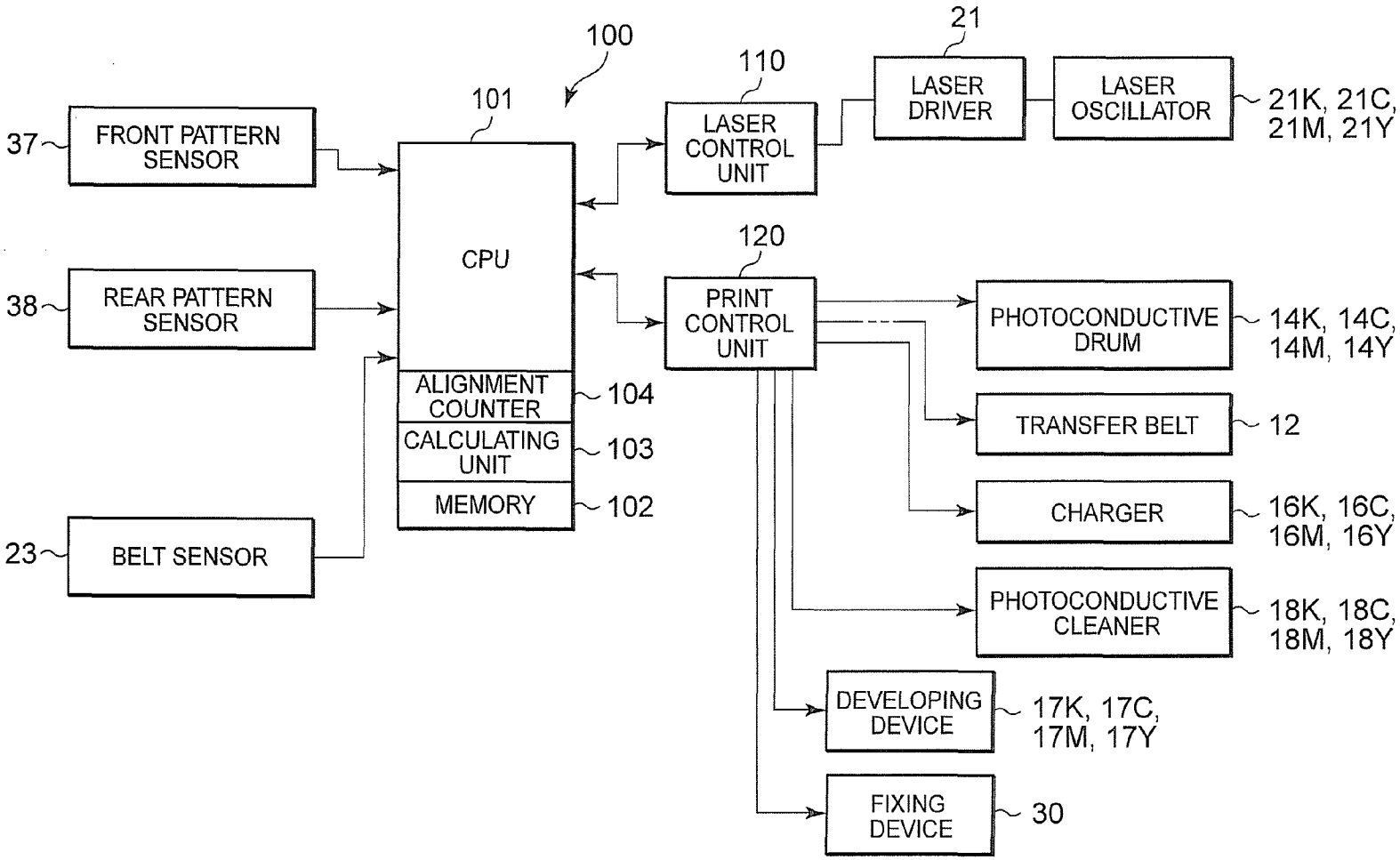
FIG. 2 is a schematic block diagram of a control system configured to mainly perform alignment adjustment in a sub-scanning direction in the first embodiment.

A block diagram of a control system 100 configured to mainly perform alignment adjustment in the sub-scanning direction of the color printer 1 is shown in FIG. 2. The front pattern sensor 37, the rear pattern sensor 38, and the belt sensor 23 are connected to a CPU 101 configured to control the entire color printer 1. The CPU 101 is connected to a laser control unit 110 and a print control unit 120. The CPU 101 includes a memory 102, a calculating unit 103, and an alignment counter 104.

The memory 102 stores, for example, various settings for controlling the laser control unit 110 and the print control unit 120. The memory 102 stores, for example, theoretical values of distance data of adjustment patterns 50 explained later or theoretical values of timings from detection of the belt marker 22 until detection of the adjustment patterns 50. The calculating unit 103 calculates, for example, from pattern information obtained from the front pattern sensor 37 or the rear pattern sensor 38, an image shift in the sub-scanning direction and calculates an alignment adjustment value of the laser control unit 110. The alignment counter 104 counts, for example, the number of times of detection of the belt marker 22 by the belt sensor 23. Alternatively, the alignment counter 104 may count, for example, the number of sheets.

The laser control unit 110 controls, for example, the laser oscillators 21K, 21C, 21M, and 21Y for the respective color components via a laser driver 21. The laser driver 21 controls writing start timings of the laser oscillators 21K, 21C, 21M, and 21Y for the respective color components of the laser exposing device 20.

The print control unit 120 controls, for example, the photoconductive drums 14K, 14C, 14M, and 14Y, the transfer belt 12, the chargers 16K, 16C, 16M, and 16Y, the developing devices 17K, 17C, 17M, and 17Y, the photoconductive cleaners 18K, 18C, 18M, and 18Y, and the fixing device 30.

Figure 3:
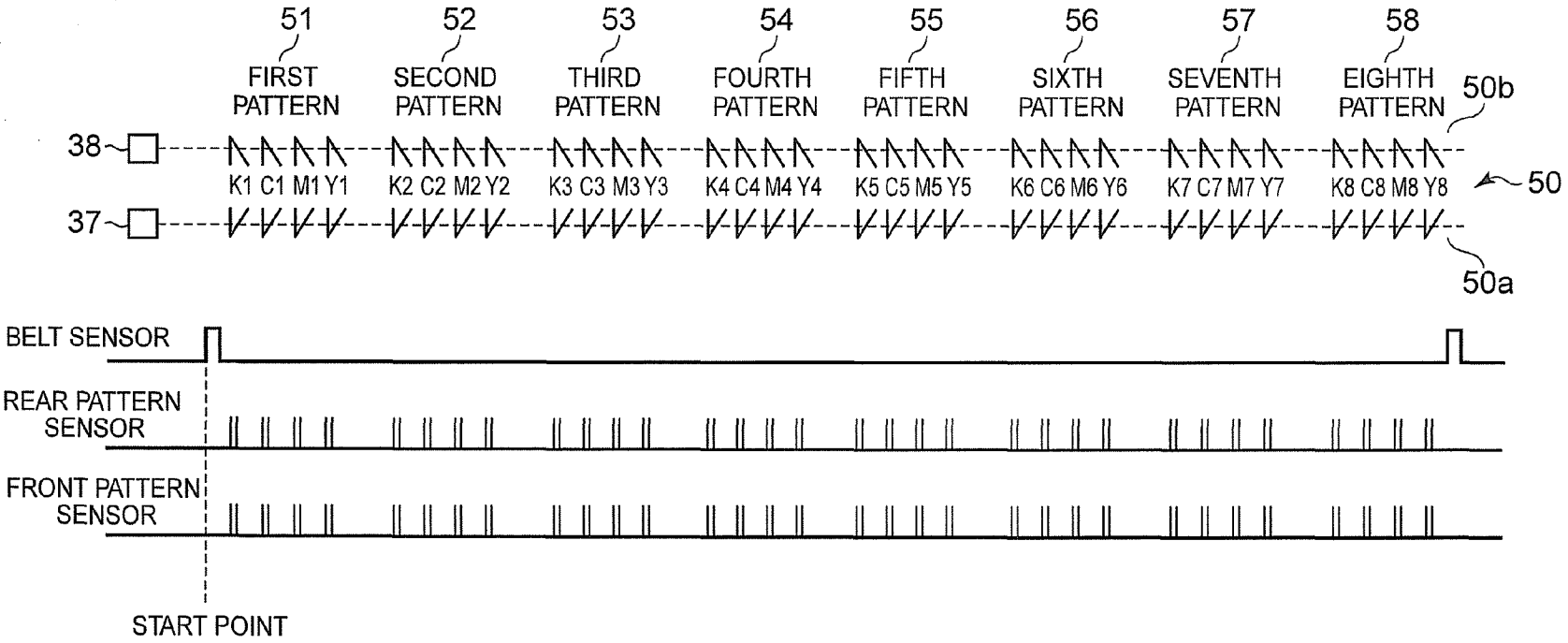
FIG. 3 is a schematic diagram for explaining an example of adjustment patterns imaged on a transfer belt during initial alignment adjustment and timing for image formation of the adjustment patterns and detection of the adjustment patterns in the first embodiment.

An example of the adjustment patterns 50 imaged over the entire circumference of the transfer belt 12 during alignment adjustment is shown in FIG. 3. The adjustment patterns 50 are, for example, wedge-type patterns including patterns of the four colors K, C, M, and Y as one set. As a reference, each of the wedge-type patterns of the four colors K, C, M, and Y is apart from the wedge-type pattern adjacent thereto by, for example, 10 mm as a theoretical space. (If a space between each of the wedge-type patterns of the four colors K, C, M, and Y and the wedge-type pattern adjacent thereto is 10 mm, which is a theoretical reference value, the positions in the sub-scanning direction of the wedge-type patterns coincide with each other.)

The alignment adjustment of the color printer 1 includes initial adjustment and intermediate adjustment. In the initial adjustment, the color printer 1 adjusts (1) the shift in the main scanning direction, (2) the shift in the sub-scanning direction, (3) the shift of magnifications, and (4) the tilt of images. The color printer 1 performs the initial adjustment, for example, during warm-up by power-on of the color printer 1, during return from a sleep mode for interrupting power supply to a heating source of the fixing device 30 or according to a request from an operator even during ready.

In the intermediate adjustment, the color printer 1 adjusts a shift in the sub-scanning direction of images. The color printer 1 performs the intermediate adjustment during a print mode in which print of the images can be immediately started when a print request for the images is sent to the color printer 1. The color printer 1 desirably periodically performs intermediate alignment adjustment during the ready after performing the initial adjustment.

The color printer 1 images, for example, eight sets of the adjustment patterns 50 from a first pattern 51 to an eighth pattern 58 on the transfer belt 12 during the initial adjustment. The color printer 1 images, with the detection of the belt marker 22 by the belt sensor 23 as a start point, eight sets of front adjustment patterns 50*a* on the front side of the transfer belt 12. The color printer 1 images eight sets of rear adjustment patterns 50*b* on the rear side of the transfer belt 12.

During the alignment adjustment, the front pattern sensor 37 detects the front adjustment patterns 50*a* and the rear pattern sensor 38 detects the rear adjustment patterns 50*b*.

(I) Initial Alignment Adjustment (Alignment in the Sub-Scanning Direction)

Figure 4:
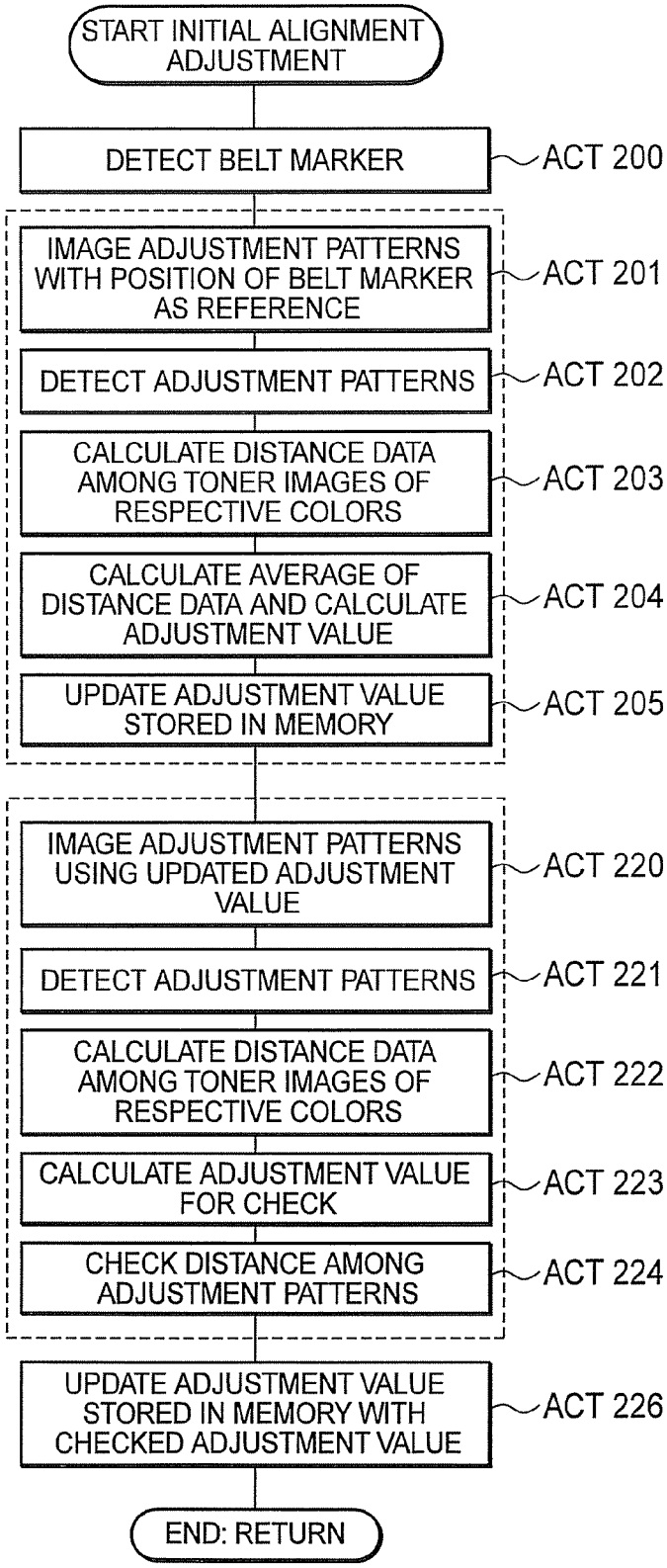
FIG. 4 is a flowchart for explaining the initial alignment adjustment in the first embodiment.

The initial alignment adjustment in the sub-scanning direction is explained below. When a power supply is turned on, the color printer 1 starts warm-up and starts the initial alignment adjustment in the sub-scanning direction shown in FIG. 4. When the initial alignment adjustment is started, the print control unit 120 controls the transfer belt 12 to travel in the arrow f direction. When the belt sensor 23 detects the belt marker 22 of the transfer belt 12 (ACT 200), the CPU 101 instructs the laser control unit 110 and the print control unit 120 to image the adjustment patterns 50. The color printer 1 images, with the position of the belt marker 22 as a reference, the eight sets of the adjustment patterns 50 from the first pattern 51 to the eighth pattern 58 shown in FIG. 3 over the entire circumference of the transfer belt 12 (ACT 201).

The front pattern sensor 37 detects the front adjustment patterns 50*a* and the rear pattern sensor 38 detects the rear adjustment patterns 50*b* (ACT 202). In the transfer belt 12, in some case, a projection or fluctuation in thickness occurs during manufacturing. Fluctuation in the thickness direction of the transfer belt 12 causes a positional shift of images in the sub-scanning directions. When the adjustment patterns 50 are imaged over the entire circumference of the transfer belt 12, in some case, a positional shift of the adjustment patterns 50 occurs in an area where fluctuation in the thickness occurs in the transfer belt 12. If the adjustment patterns 50 positionally shift from one another, distance data among toner images of the respective colors of eight sets of the adjustment patterns 50 detected by the front pattern sensor 37 or the rear pattern sensor 38 are different. For the alignment adjustment in the sub-scanning direction, the calculating unit 103 calculates distance data of the detected eight sets of the adjustment patterns 50 (ACT 203).

The calculating unit 103 calculates an average of the calculated distance data and calculates an adjustment value (ACT 204). The CPU 101 updates an adjustment value stored in the memory 102 to the calculated adjustment value (ACT 205).

Further, the CPU 101 checks whether the adjustment value updated in ACT 205 is correct. The CPU 101 adjusts output timings of lasers of the laser oscillators 21K, 21C, 21M, and 21Y using the updated adjustment value updated in ACT 205 and images eight sets of the adjustment patterns 50 from the first pattern 51 to the eighth pattern 58 shown in FIG. 3 over the entire circumference of the transfer belt 12 (ACT 220).

As in ACT 202 to ACT 204, the CPU 101 detects the eight sets of the adjustment patterns 50 imaged anew (ACT 221) and calculates distance data of toner images of the respective colors of the eight sets of the adjustment patterns 50 (ACT 222). The calculating unit 103 calculates an adjustment value for check from the calculated distance data of the toner images of the respective colors (ACT 223).

The CPU 101 checks, from the calculated adjustment value for check, whether a distance among the toner images of the respective colors of the adjustment patterns 50 is within a tolerance of 10 mm as the theoretical reference value (ACT 224). The CPU 101 updates the adjustment value stored in the memory 102 to the adjustment value for check (ACT 226) and finishes the initial alignment adjustment. If the distance among the toners of the respective colors deviates from the tolerance of the theoretical reference value in ACT 224, the CPU 101 may perform the check in ACT 220 to ACT 224 again. During the initial alignment adjustment, the check of patterns after adjustment is repeated, whereby the alignment adjustment accuracy of the color printer 1 is further improved.

Figure 5:
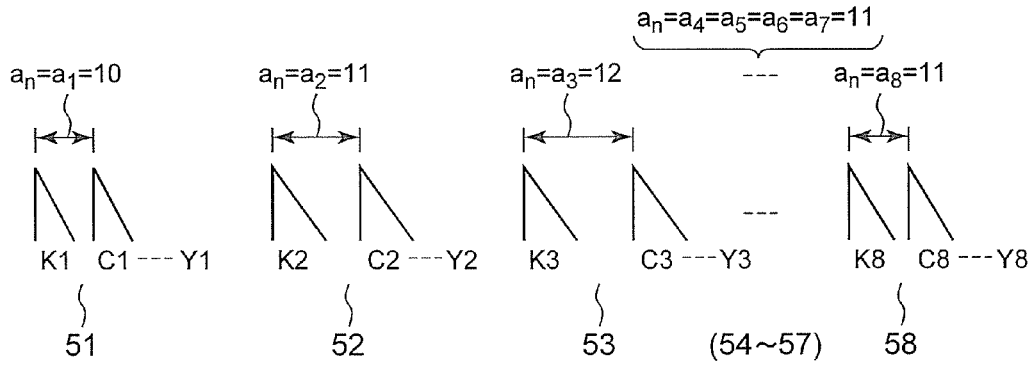
FIG. 5 is a schematic diagram for explaining an example of distance data between black (K) images and cyan (C) images of the adjustment patterns imaged on the transfer belt in the first embodiment.

For example, as shown in FIG. 5, distance data between images Kn of black (K) and images Cn of cyan (C) from the first pattern 51 to the eighth pattern 58 is represented as (an). For the alignment adjustment in the sub-scanning direction, the calculating unit 103 calculates an average (X) obtained by averaging the distance data (an) of the images Kn of black (K) and the images Cn of cyan (C) and sets the average (X) as an initial adjustment value (h0).

In the same manner as the alignment adjustment for black (K) and cyan (C), the calculating unit 103 calculates an initial adjustment value for alignment adjustment between cyan (C)

and magenta (M) and between magenta (M) and yellow (Y). A reference for the alignment adjustment is not limited to black (K).

Figure 6:
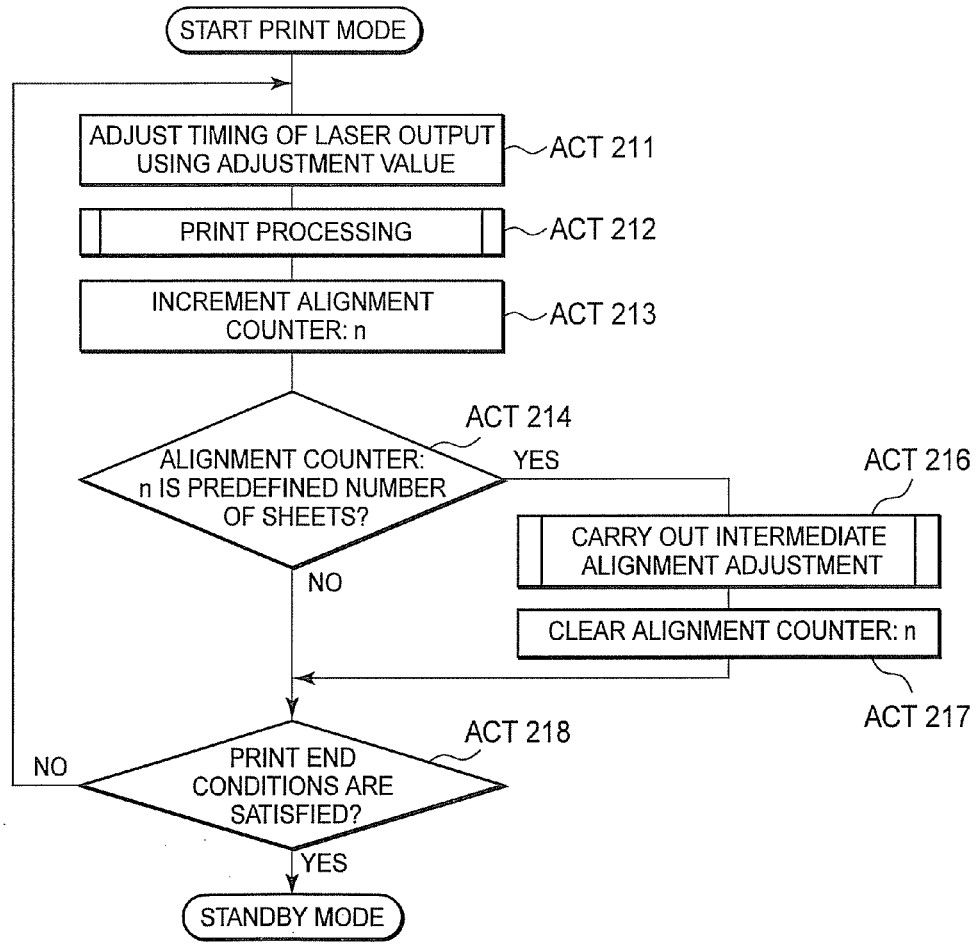
FIG. 6 is a flowchart for explaining image print in the first embodiment.

When the color printer 1 finishes warm-up operation including the initial alignment adjustment, the color printer 1 switches to a ready mode. When a print request for images is received, the color printer 1 starts print operation shown in FIG. 6. The CPU 101 recognizes, from detection information of the belt marker 22, respective image forming positions for the first pattern 51 to the eighth pattern 58 on the transfer belt 12. The CPU 101 recognizes, as image shift amounts in the sub-scanning direction, differences between the distance data (an) of the images Kn of black (K) and the images Cn of cyan (C) and the initial adjustment value (h0) in the positions of the transfer belt 12. (Concerning each of differences between cyan (C) and magenta (M) and between magenta (M) and yellow (Y), the CPU 101 recognizes image shift amounts in the sub-scanning direction in the same manner.)

During print of the images, the CPU 101 shifts, to correspond to the positions of the transfer belt 12, output timing of the laser oscillator 21C for cyan (C) with respect to oscillation timing of the laser oscillator 21K for black (K) according to the initial adjustment value (h0) (ACT 211).

For example, the distance data (an) of the first pattern 51, the distance data (an) of the second pattern 52, the distance data (an) of the third pattern 53, and the like calculated in ACT 222 are respectively represented as a1=10, a2=11, a3=12, and the like and the average (X) from the first pattern 51 to the eighth pattern calculated in ACT 223 is represented as initial adjustment value (h0)=11. (A difference between the initial adjustment value (h0) and the distance data (an))=an image shift amount is (−1), (0), (+1), and the like respectively in the first pattern 51, the second pattern 52, the third pattern 53, and the like.

Figure 7:
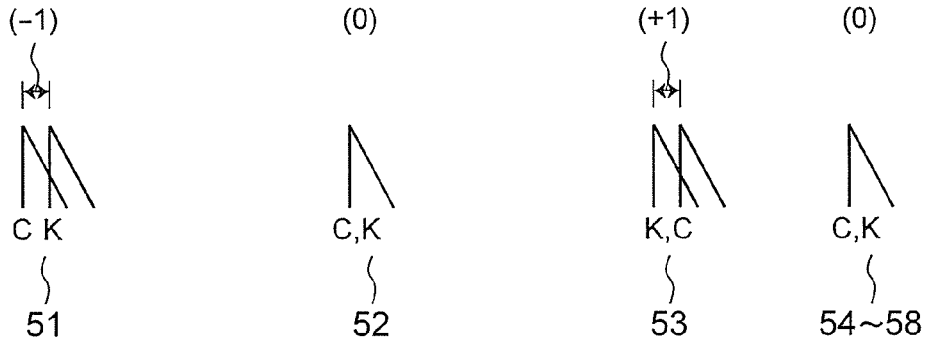
FIG. 7 is a schematic diagram for explaining an example of black (K) and cyan (C) images of print images printed on the transfer belt in the first embodiment.

An example of a print image obtained in ACT 212 after adjusting the output timing of the laser oscillator 21C for cyan (C) using the initial adjustment value (h0)=11 is shown in FIG. 7. In the position of the first pattern 51, a cyan (C) image shifts by −1 with respect to a black (K) image. In the position of the second pattern 52, the black (K) image and the cyan (C) image coincide with each other. In the position of the third pattern 53, the cyan (C) image shifts by +1 with respect to the black (K) image. In the position of the eighth pattern 58, the cyan (C) image shifts by −1 with respect to the black (K) image.

After alignment adjustment, when a print request is received, the color printer 1 subjects the images to print processing (ACT 212). During print of the images, the image shift amounts of the black (K) image and the cyan (C) image of the transfer belt 12 are averaged as shown in FIG. 7.

While the image print is performed, the alignment counter 104 sequentially counts up the number of times of detection of the belt marker 22 by the belt sensor 23 (ACT 213). While the image print is performed, if the number counted by the alignment counter 104 reaches a predefined number of sheets (Yes in Act 214), the color printer 1 performs the intermediate alignment adjustment explained later (ACT 216). In ACT 217, the color printer 1 clears a count value of the alignment counter 104 and proceeds to ACT 218.

If the number counted by the alignment counter 104 does not reach the predefined number of sheets (No in ACT 214), the color printer 1 proceeds to ACT 218. If image print end conditions are not satisfied (No in ACT 218), the color printer 1 repeats ACT 211 to ACT 218. If the color printer 1 finishes the image print (Yes in ACT 218), the color printer 1 stands by for the next print.

(II) Intermediate Alignment Adjustment (Alignment in the Sub-Scanning Direction)

The intermediate alignment adjustment in the sub-scanning direction is explained. Even after the color printer 1 finishes the initial adjustment, a positional shift of toner images tends to occur because of a change in environmental characteristics in the apparatus. Even during print, the color printer 1 periodically performs alignment adjustment as indicated by ACT 216. However, the positional shift of the toner images during the print is considered to be mainly caused by fluctuation in characteristics of the optical system of the laser exposing device 20 due to a temperature rise in the apparatus. Fluctuation in the transfer belt 12 due to the temperature rise in the apparatus can be generally neglected. The positional shift of the toner images due to the temperature rise in the apparatus is unrelated to a region of the transfer belt 12. The positional shift of the toner images due to the temperature rise in the apparatus appears in common over the entire circumference of the transfer belt 12.

Therefore, it is unnecessary to detect the positional shift of the toner images due to the temperature rise in the apparatus by imaging plural sets of adjustment patterns on the transfer belt 12. An adjustment value for the positional shift of the toner images due to the temperature rise in the apparatus can be obtained by imaging one set of an adjustment pattern on the transfer belt 12 and detecting the imaged one set of the adjustment pattern. An imaging position of the one set of the adjustment pattern imaged on the transfer belt 12 for the intermediate alignment adjustment is not limited. For the intermediate alignment adjustment, the color printer 1 may image the one set of the adjustment pattern in any position of the transfer belt 12.

Figure 8:
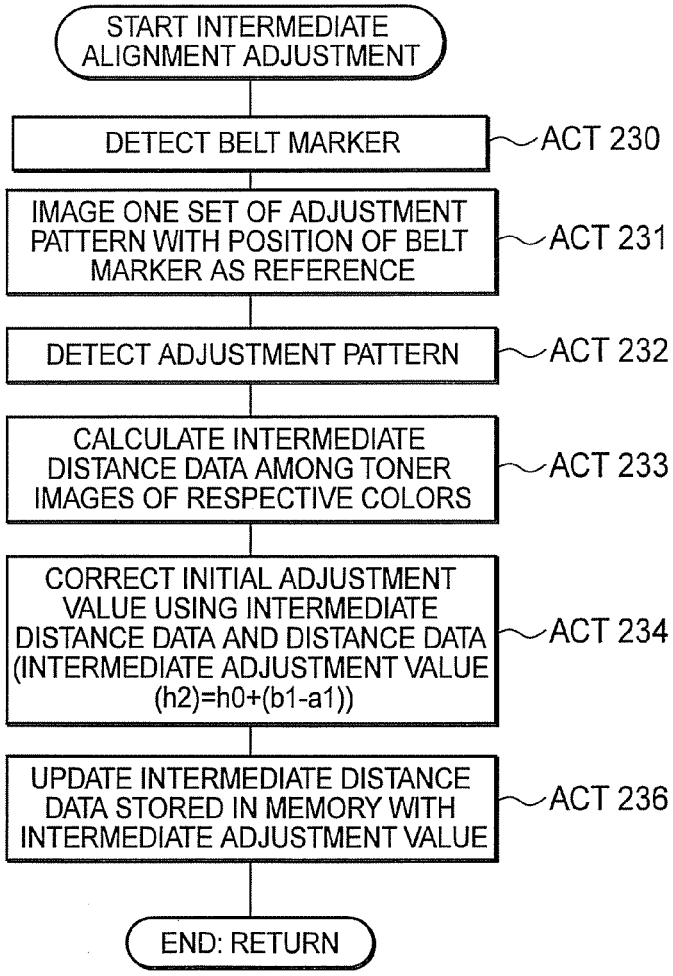
FIG. 8 is a flowchart for explaining intermediate alignment adjustment in the first embodiment.
Figure 9:
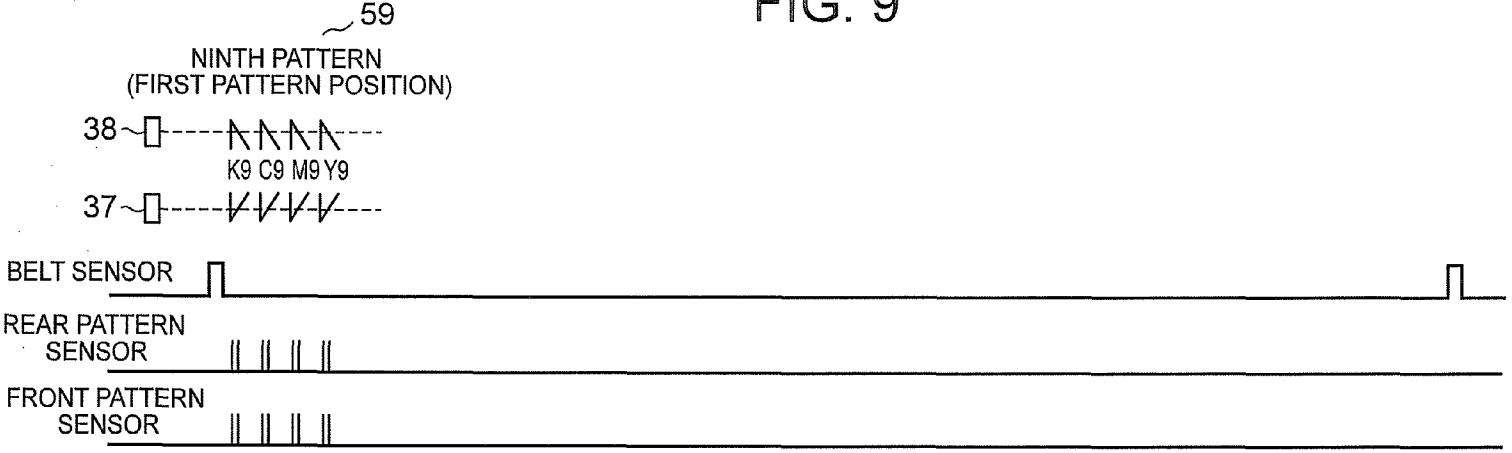
FIG. 9 is a schematic diagram for explaining an example of adjustment patterns imaged on a transfer belt during the intermediate alignment adjustment and timing for image formation of the adjustment patterns and detection of the adjustment patterns in the first embodiment.

When the intermediate alignment adjustment shown in FIG. 8 is started and the belt sensor 23 detects the belt marker 22 (ACT 230), the color printer 1 images one set of a ninth pattern 59 shown in FIG. 9 on the transfer belt 12 (ACT 231). As the ninth pattern 59, a pattern having a shape the same as that of the first pattern 51 is imaged in a position the same as the position of the first pattern 51. The front pattern sensor 37 and the rear pattern sensor 38 detect the ninth pattern 59 (ACT 232).

For the alignment adjustment in the sub-scanning direction, the calculating unit 103 calculates distance data of the first pattern 51 for initial adjustment and intermediate distance data among toner images of the respective colors as intermediate detection values of the ninth pattern 59 for intermediate adjustment (ACT 233). There is a difference between the distance data of the first pattern 51 and the intermediate distance data of the ninth pattern 59 because of fluctuation in the characteristics of the optical system of the laser exposing device 20 due to the temperature rise inside the color printer 1.

Figure 10:
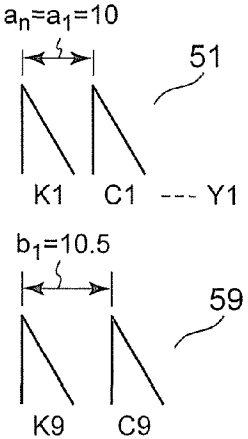
FIG. 10 is a schematic diagram for explaining comparison of distance data and intermediate distance data imaged on the transfer belt in the first embodiment.

For example, as shown in FIG. 10, distance data a1 between a pattern K1 of black (K) and a pattern C1 of cyan (C) of the first pattern 51 and intermediate distance data b1 between a pattern K9 of black (K) and a pattern C9 of cyan (C) of the ninth pattern 59 are compared. For the alignment adjustment in the sub-scanning direction, the calculating unit 103 adds a difference (b1−a1) between the distance data a1 between the image K1 of black (K) and the image C1 of cyan (C) of the first pattern 51 and the intermediate distance data b1 between the image K9 of black (K) and the image C9 of cyan (C) of the ninth pattern 59 to the initial adjustment value (h0). The calculating unit 103 sets, as an intermediate adjustment value (h2), a value (h0+(b1−a1)) obtained by adding the difference (b1−a1) between the distance data a1 of the first pattern 51 and the intermediate distance data b1 of the ninth pattern 59 to the initial adjustment value (h0) (ACT 234). The intermediate adjustment value (h2)=h0+(b1−a1) is common over the entire circumference of the transfer belt 12. The CPU 101 updates the adjustment value stored in the memory 102 to the calculated intermediate adjustment value (h2) (ACT 236).

The CPU 101 recognizes, as image shift amounts, differences between the distance data (an) between a pattern Kn of black (K) and a pattern Cn of cyan (C) and the intermediate adjustment value (h2) in the positions of the transfer belt 12 using the intermediate adjustment value (h2) instead of the initial adjustment value (h0). During printing of the images, the CPU 101 shifts, to correspond to the positions of the intermediate belt 12, output timing of the laser oscillator 21C for cyan (C) with respect to oscillation timing of the laser oscillator 21K for black (K) according to the intermediate adjustment value (h2).

For example, in ACT 233, the calculating unit 103 sets the intermediate distance data b1 of the ninth pattern 59 to 10.5. In ACT 234, the calculating unit 103 adds a difference (0.5) between the intermediate distance data b1=10.5 of the ninth pattern 59 and the distance data a1=10 of the first pattern 51 to the initial adjustment value (h0)=11 and obtains an intermediate adjustment value h2=11.5.

During the printing of the images, the CPU 101 shifts, to correspond to the positions of the transfer belt 12, output timing of the laser oscillator 21C for cyan (C) with respect to oscillation timing of the laser oscillator 21K for black (K) according to the image shift amounts.

In the intermediate adjustment, the CPU 101 performs the intermediate alignment adjustment between black (K) and cyan (C) over the entire circumference of the transfer belt 12 using the intermediate adjustment value (h2) obtained from the one set of the ninth pattern 59 imaged on the transfer belt 12.

As in the intermediate alignment adjustment between black (K) and cyan (C), the CPU 101 performs the intermediate alignment adjustment between cyan (C) and magenta (M) and between magenta (M) and yellow (Y) according to the one set of the ninth pattern 59 imaged on the transfer belt 12.

When a print request is received, the color printer 1 adjusts output timings of lasers of the laser oscillators 21K, 21C, 21M, and 21Y using the intermediate adjustment value (h2) and prints images (ACT 212). After printing the images, the color printer 1 periodically repeats the intermediate alignment adjustment in ACT 230 to ACT 236.

Figure 11:
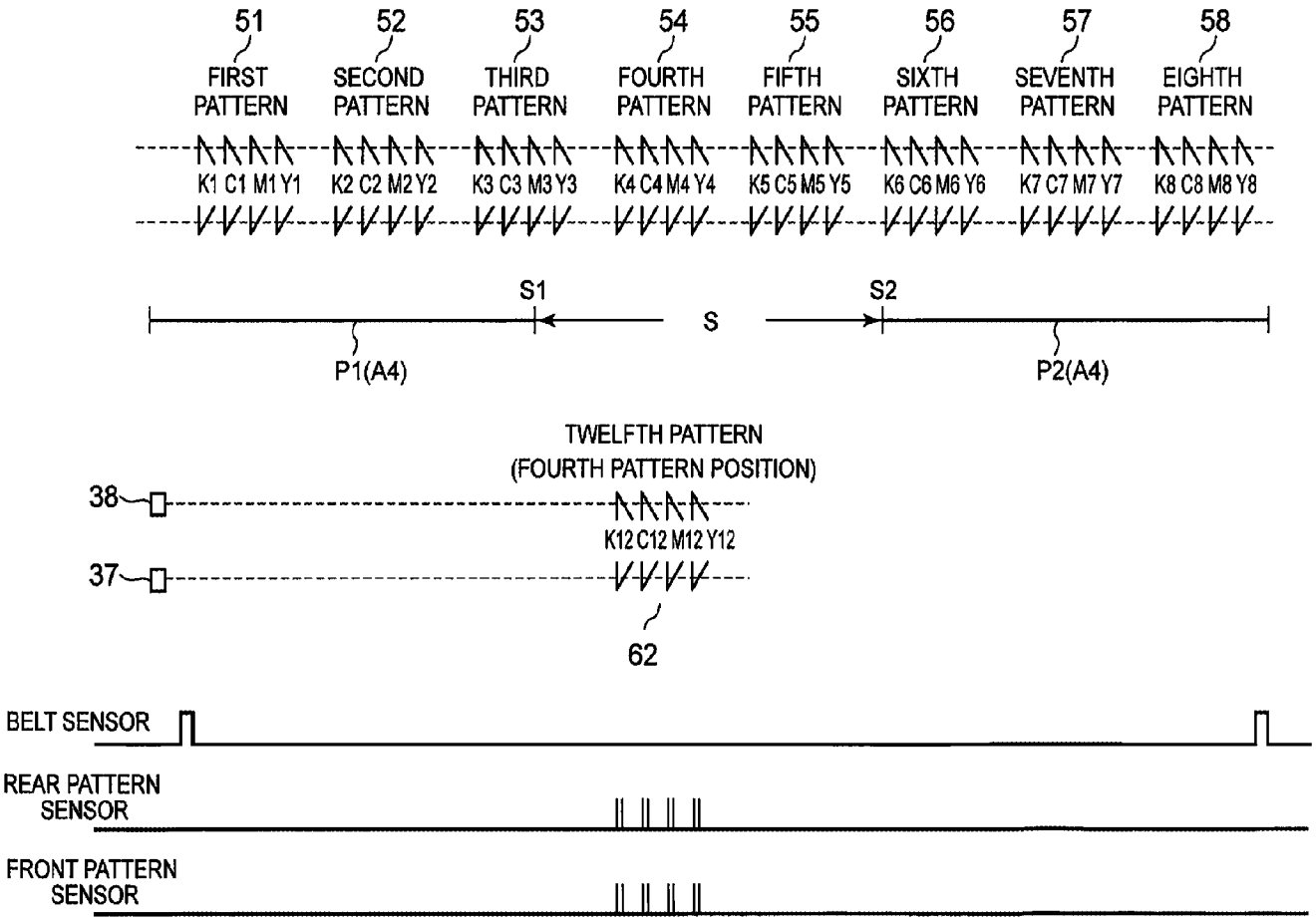
FIG. 11 is a schematic diagram for explaining an example of intermediate alignment adjustment during continuous print in the first embodiment.

One set of an adjustment pattern used for the intermediate adjustment is not limited to the ninth pattern 59 corresponding to the first pattern 51. For example, if the number counted by the alignment counter 104 reaches the predefined number of sheets (Yes in ACT 214) during continuous print for the A4 size (the JIS standard), the color printer 1 temporarily suspends the continuous print and performs the intermediate adjustment. For example, as shown in FIG. 11, the color printer 1 performs the intermediate alignment adjustment in a space (S) between print P1 before the continuous print is suspended and print P2 at the time when the continuous print is resumed.

If a position (S1) where the continuous print is suspended is before an image forming position of the fourth pattern 54 of the initial adjustment for the transfer belt 12, the color printer 1 images one set of a twelfth pattern 62 in the image forming position of the fourth pattern 54. The shape of the twelfth pattern 62 is the same as the shape of the fourth pattern 54 in the initial adjustment. The twelfth pattern 62 is an intermediate pattern that can be imaged first in the space (S) after the suspension of the continuous print.

The calculating unit 103 sets, as the intermediate adjustment value (h2), a value obtained by adding a difference (b12−a4) between the distance data (a4) of the fourth pattern 54 for the initial adjustment and intermediate distance data (b12) of the twelfth pattern for the intermediate adjustment to the initial adjustment value (h0). The same result is obtained even though an adjustment pattern in any position corresponding to the first pattern 51 to the eighth pattern 58 is used as one set of an adjustment pattern used for the intermediate adjustment value (h2).

After imaging the twelfth pattern 62, the color printer 1 resumes the continuous print from, for example, (S2) of the transfer belt 12. After the suspension of the continuous print, the color printer 1 can immediately image patterns for the intermediate alignment adjustment on the transfer belt 12 and perform the intermediate alignment adjustment without waiting for the transfer belt 12 to reach the image forming position of the first pattern 51 for the initial adjustment. During the intermediate adjustment, the color printer 1 images one set of an adjustment pattern in the space (S) to thereby reduce suspension time in performing the intermediate adjustment during the continuous print.

According to the first embodiment, in the initial alignment adjustment, the color printer 1 calculates an average (X) of the eight sets of the adjustment patterns 50 and obtains the initial adjustment value (h0). The color printer 1 adjusts output timings of laser oscillators 21K, 21C, 21M, and 21Y according to image shift amounts obtained from the initial adjustment value (h0) and performs the alignment adjustment. In the intermediate alignment adjustment, the color printer 1 obtains the intermediate adjustment value (h2) from the ninth pattern 59 imaged in a position of the transfer belt 12 the same as the position of the first pattern 51 and in the shape the same as the shape of the first pattern 51. The color printer 1 adjusts output timings of the laser oscillators 21K, 21C, 21M, and 21Y and performs the alignment adjustment according to image shift amounts obtained from the intermediate adjustment value (h2). In the intermediate alignment adjustment, the color printer 1 can perform the alignment adjustment simply by imaging the one set of the ninth pattern 59 on the transfer belt 12. In the intermediate alignment adjustment, it is unnecessary to image plural sets of adjustment patterns over the entire circumference of the transfer belt 12. Therefore, alignment adjustment time is reduced.

Second Embodiment

In a second embodiment, two initial adjustment values are switched in the first embodiment. In the second embodiment, a print area of images is switched in the first embodiment. In the second embodiments, components the same as those explained in the first embodiment are denoted by the same reference numerals and signs and detailed explanation of the components is omitted.

Figure 12:
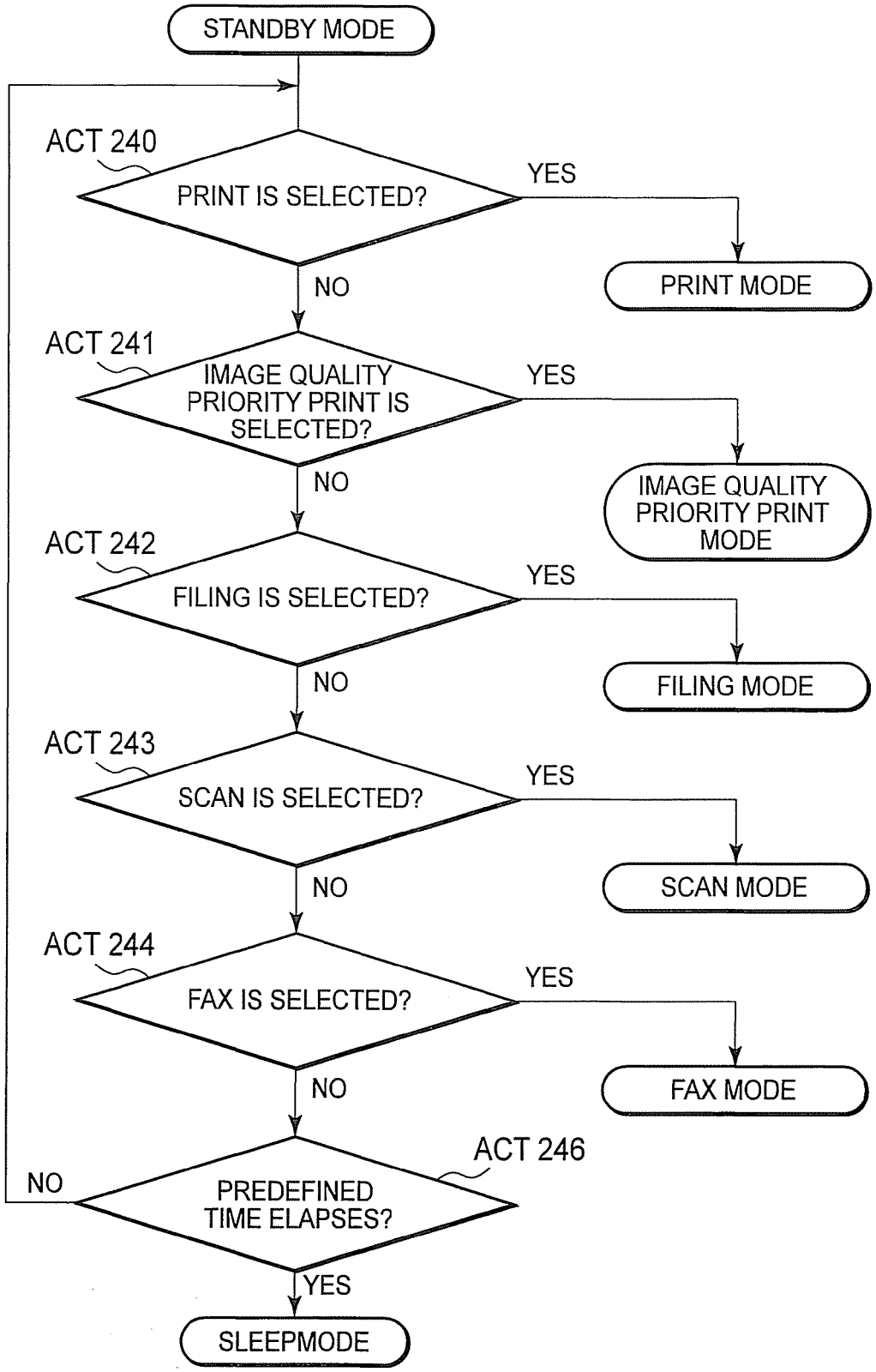
FIG. 12 is a flowchart for explaining switching of a mode of a color printer according to a second embodiment.

The color printer 1 has a speed priority print mode for giving priority to print speed and an image quality priority print mode for giving priority to print image quality. An operator switches the speed priority print mode and the image quality priority print mode from, for example, a control panel of the color printer 1. During a standby mode of the color printer 1, for example, as shown in FIG. 12, the operator selects various modes from the control panel.

If the operator selects print (Yes in ACT 240), the color printer 1 switches to a print mode. The print mode is the speed priority print mode. If the operator selects the image quality priority print (Yes in ACT 241), the color printer 1 switches from the speed priority print mode to the image quality priority print mode. If the operator selects filing (Yes in ACT 242), the color printer 1 switches to a filing mode. If the operator selects scan (Yes in ACT 243), the color printer 1 switches to a scan mode. If the operator selects facsimile (Yes in ACT 244), the color printer 1 switches to a facsimile mode. In a state of the standby mode, if a predefined time elapses (Yes in ACT 246), the color printer 1 switches to a sleep mode.

In some case, the transfer belt 12 has an area where an image blur is conspicuous because of a projection or fluctuation in thickness that occurs during manufacturing. When the area with the conspicuous image blur is present in the transfer belt 12, if an initial adjustment value is calculated targeting the entire area of the transfer belt 12, it is likely that accuracy of the initial adjustment value falls. In the second embodiment, an initial adjustment value is calculated targeting an area excluding the area with the conspicuous image blur of the transfer belt 12 to improve the accuracy of the initial adjustment value. In the second embodiment, the area with the conspicuous image blur of the transfer belt 12 is not used for print of images, whereby a higher-quality print image is obtained.

The color printer 1 according to the second embodiment has a speed priority adjustment value (H1) and an image quality priority adjustment value (H2) as the initial adjustment value. The speed priority adjustment value (H1) refers to the initial adjustment value (h0) obtained in the initial alignment adjustment of (I) explained above. The initial adjustment value (h0) as the speed priority adjustment value (H1) is an adjustment value obtained by averaging all the distance data (an) of the eight sets of the adjustment patterns 50 imaged over the entire circumference of the transfer belt 12 during the initial alignment adjustment.

The color printer 1 according to the second embodiment includes, as image print areas, an area including the entire circumference of the transfer belt 12 and an OK area excluding an NG area, which is an image formation inhibited area, from the entire circumference of the transfer belt 12.

In the speed priority print mode, the color printer 1 performs the initial alignment adjustment of (I) and the intermediate alignment adjustment of (II) using the speed priority adjustment value (H1) as the initial adjustment value. In the speed priority print mode, the color printer 1 obtains a print image using the entire circumference of the transfer belt 12.

Figure 13:
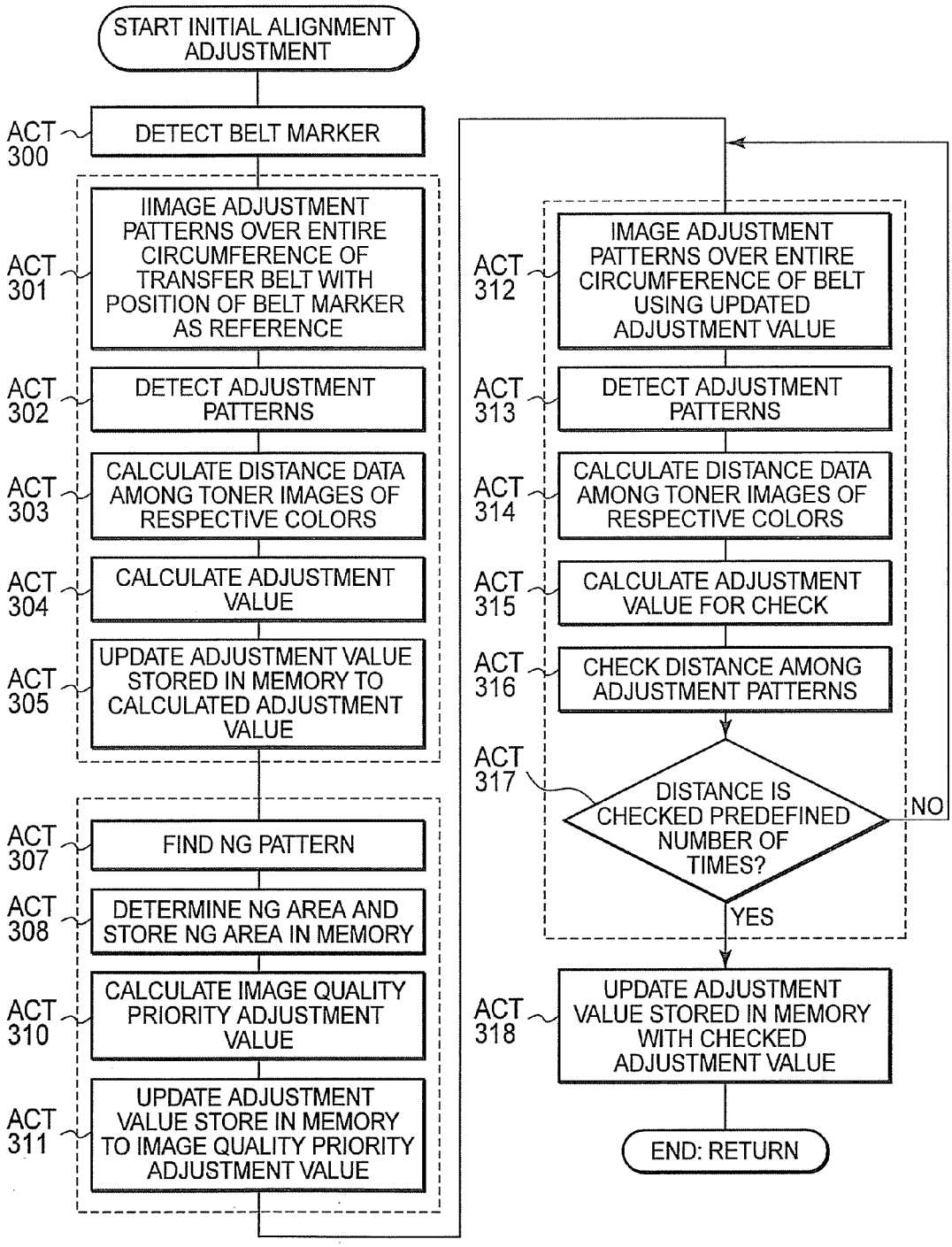
FIG. 13 is a flowchart for explaining initial alignment adjustment in an image quality priority print mode in the second embodiment.

(III) Initial Alignment Adjustment (Alignment in the Sub-Scanning Direction) in the Image Quality Priority Print Mode If the operator selects the image quality priority print mode during the standby mode (Yes in ACT 241), the color printer 1 starts the initial alignment adjustment in the sub-scanning direction shown in FIG. 13. However, the color printer 1 does not have to perform the initial alignment adjustment in the image quality priority print mode every time the operator selects the image quality priority print mode. For example, during the initial alignment adjustment of (I) in the first embodiment, the initial alignment adjustment in the image quality priority print mode is set in advance. If the operator selects the image quality priority print mode, the color printer 1 obtains an image quality priority print image using the already-set initial alignment adjustment in the image quality priority print mode.

In the initial alignment adjustment of the image quality priority print mode, when the belt sensor 23 detects the belt marker 22 of the transfer belt 12 (ACT 300), the color printer 1 images, with the position of the belt marker 22 as a reference, the eight sets of the adjustment patterns 50 from the first pattern 51 to the eighth pattern 58 shown in FIG. 3 on the entire circumference of the transfer belt 12 (ACT 301).

The front pattern sensor 37 and the rear pattern sensor 38 detect the eight sets of the adjustment patterns 50 (ACT 302). For the alignment adjustment in the sub-scanning direction, the calculating unit 103 calculates distance data among toner images of the respective colors of the detected eight sets of the adjustment patterns 50 (ACT 303).

The calculating unit 103 calculates a total average of the distance data of the eight sets of the adjustment patterns 50 and calculates an adjustment value (h1) (ACT 304). The CPU 101 updates the adjustment value stored in the memory 102 to the calculated adjustment value (h1) (ACT 305).

As in the first embodiment, for the alignment adjustment in the sub-scanning direction, the calculating unit 103 calculates a total average (X)=(adjustment value−1) of the distance data (an) between the images Kn of black (K) and the images Cn of cyan (C). The calculating unit 103 calculates (adjustment value−1) for the alignment adjustment between cyan (C) and magenta (M) and between magenta (M) and yellow (Y) in the same manner.

The CPU 101 finds a NG pattern from the distance data (an) of the eight sets of the adjustment patterns 50 calculated in ACT 303 (ACT 307). The CPU 101 compares the adjustment value (h1) updated in ACT 305 and the distance data (an) and sets an adjustment pattern having a largest difference from the adjustment value (h1) as the NG pattern.

Figure 14:
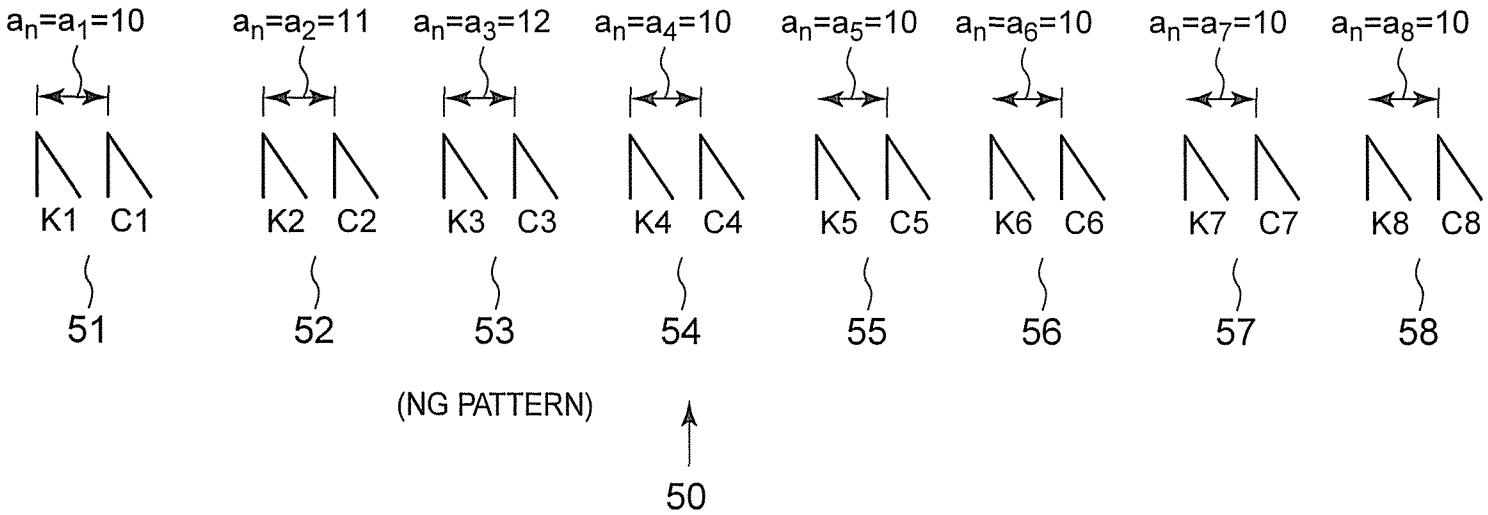
FIG. 14 is a schematic diagram for explaining an example of distance data between black (K) images and cyan (C) images of adjustment patterns imaged on a transfer belt in the second embodiment.

For example, as shown in FIG. 14, the distance data (an) of the first pattern 51, the distance data (an) of the second pattern 52, the distance data (an) of the third pattern 53, and the distance data (an) of the fourth pattern 54 to the eighth pattern 58 calculated in ACT 303 are respectively represented as a1=10, a2=11, a3=12, and (a4 to a8)=10. The average (X) from the first pattern 51 to the eighth pattern 58 calculated in ACT 204 is the adjustment value (h1)=10.375. Distance data having a largest difference from the adjustment value (h1)=10.375 is the third pattern 53, the distance data (an) of which is a3=12. Therefore, the third pattern 53 is set as the NG pattern.

Figure 15:
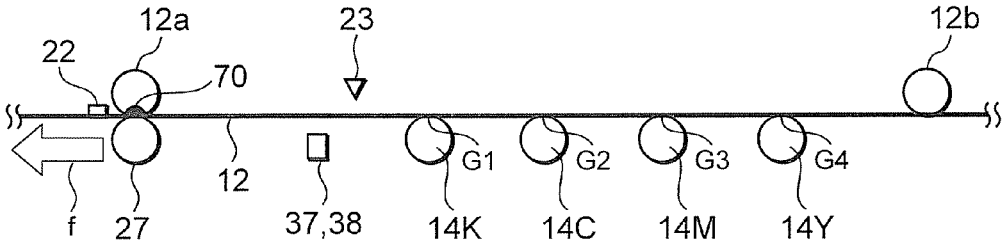
FIG. 15 is a schematic diagram for explaining a position of blur occurrence due to a projection of the transfer belt in the second embodiment.

In ACT 308, the CPU 101 determines a NG area of the transfer belt 12 and stores the NG area in the memory 102. The NG area is an area in which an image blur is conspicuous and a toner image is not printed during the image quality priority print mode. For example, as shown in FIG. 15, when a projection 70 that occurs in the transfer belt 12 passes through the secondary transfer roller 27, the traveling speed of the transfer belt 12 fluctuates. When the speed of the transfer belt 12 fluctuates in this way, blurs occur in toner images being transferred from the photoconductive drums 14K, 14C, 14M, and 14Y to the transfer belt 12.

In FIG. 15, when the projection 70 passes through the secondary transfer roller 27, an image of black (K) blurs in G1 of the transfer belt 12, an image of cyan (C) blurs in G2 of the transfer belt 12, an image of magenta (M) blurs in G3 of the transfer belt 12, and an image of yellow (Y) blurs in G4 of the transfer belt 12. In G1 to G4 of the transfer belt 12, a toner image of one color in which a blur occurs and toner images of the remaining three colors cause a positional shift and deteriorates image quality. Therefore, a section from G1 to G4 of the transfer belt 12 is set as the NG area.

Figure 16:
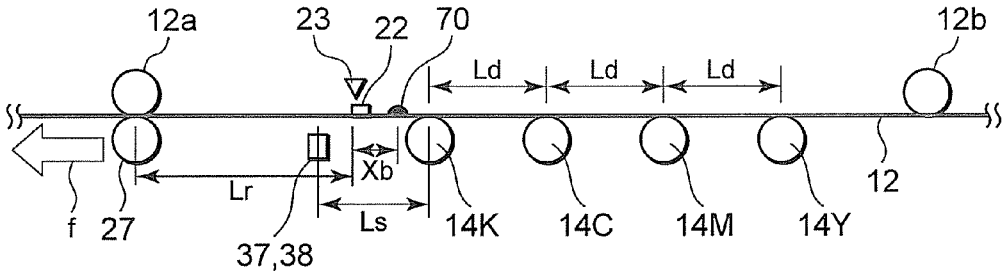
FIG. 16 is a schematic diagram for explaining detection of a position of blur occurrence due to the projection of the transfer belt in the second embodiment.

Detection of the NG area is explained below. For example, as shown in FIG. 16, a distance among the photoconductive drums 14K, 14C, 14M, and 14Y is represented as Ld (mm), a distance from the photoconductive drum 14K for black (K) to the front pattern sensor 37 and the rear pattern sensor 38 is represented as Ls (mm), a distance from the front pattern sensor 37 and the rear pattern sensor 38 to the secondary transfer roller 27 is represented as Lr (mm), and a distance from the distal end of the belt marker 22 to the projection 70 is represented as Xb (mm). Ld, Ls, and Lr are peculiar values of the color printer 1. Xb is different depending on the transfer belt 12.

When the transfer belt 12 moves by [Lr+Xb] (mm) with reading of the distal end of the belt marker 22 by the belt sensor 23 as a start point, the projection 70 reaches the secondary transfer roller 27. Traveling times of the transfer belt 12 respectively corresponding to the distances Ld (mm), Ls (mm), Lr (mm), and Xb (mm) are represented as tLd (sec), tLs (sec), tLr (sec), and tXb (sec). When traveling speed (process speed) of the transfer belt 12 is represented as Vd (mm/s), tLd=Ld/Vd (sec), tLs=Ls/Vd (sec), tLr=Lr/Vd (sec), and tXb=Xb/Vd (sec).

Figure 17:
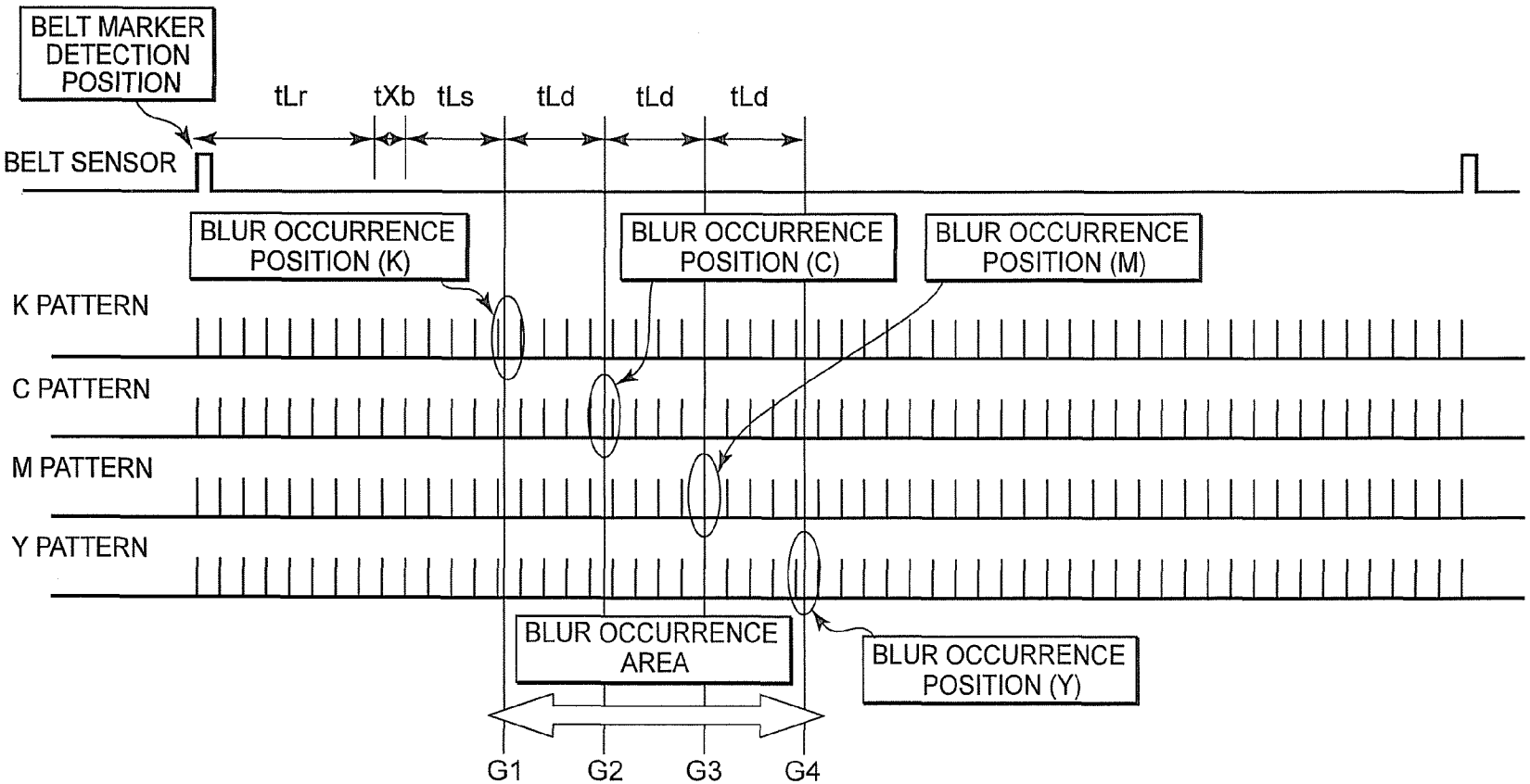
FIG. 17 is a diagram for explaining detection timing for a position of blur occurrence due to the projection of the transfer belt in the second embodiment.

Time from detection of the belt marker 22 by the belt sensor 23 until the section from G1 to G4 as the NG area of the transfer belt 12 reaches the front pattern sensor 37 or the rear pattern sensor 38 is calculated and the section from G1 to G4 of the transfer belt 12 is detected. As shown in FIG. 17, the blur occurrence position G1 of the image of black (K) is in a position of (tLr+tXb+tLs) (sec) after the detection of the belt marker 22 by the belt sensor 23. The blur occurrence position G2 of the image of cyan (C) is in a position of (tLr+tXb+tLs+tLd) (sec) after the detection of the belt marker 22 by the belt sensor 23. The blur occurrence position G3 of the image of the magenta (M) is in a position of (tLr+tXb+tLs+2tLd) (sec) after the detection of the belt marker 22 by the belt sensor 23. The blur occurrence position G4 of the image of yellow (Y) is in a position of (tLr+tXb+tLs+3tLd) (sec) after the detection of the belt marker 22 by the belt sensor 23.

The CPU 101 determines a section from (tLr+tXb+tLs) (sec) to (tLr+tXb+tLs+3tLd) (sec) after the detection of the belt marker 22 by the belt sensor 23 as an NG area of the transfer belt 12 and stores the NG area in the memory 102 (ACT 308).

In ACT 310, the calculating unit 103 calculates the image quality priority adjustment value (H2). The calculating unit 103 excludes the NG pattern (the third pattern 53) found in ACT 307 from the eight sets of the adjustment patterns 50 from the first pattern 51 to the eighth pattern 58. The calculating unit 103 calculates an average of the distance data of the remaining seven sets of the adjustment patterns 50 excluding the NG pattern and calculates the image quality priority adjustment value (H2). The CPU 101 updates the adjustment value stored in the memory 102 to the image quality priority adjustment value (H2) (ACT 311).

For example, the calculating unit 103 calculates an average (X) of the distance data (an)=a1=10 of the first pattern 51, the distance data (an)=a2=11 of the second pattern 52, and the distance data (an)=(a4 to a8)=10 of the fourth pattern 54 to the eighth pattern 58 excluding the third pattern 53. The average (X)=(the image quality priority adjustment value (H2))=10.143.

The CPU 101 further checks the image quality priority adjustment value (H2) updated in ACT 311. The CPU 101 adjusts output timings of the lasers of the laser oscillators 21K, 21C, 21M, and 21Y using the adjustment value updated in ACT 311 and images the eight sets of the adjustment patterns 50 from the first pattern 51 to the eighth pattern 58 shown in FIG. 3 on the entire circumference of the transfer belt 12 again (ACT 312). The CPU 101 detects the eight sets of the adjustment patterns 50 in the same manner as ACT 302 to ACT 304 (ACT 313) and calculates distance data among the toner images of the respective colors of the eight sets of the adjustment patterns 50 (ACT 314). The calculating unit 103 calculates an adjustment value for check from the calculated distance data (ACT 315).

The CPU 101 checks, from the calculated adjustment value for check, whether the distance among the toner images of the respective colors of the adjustment patterns 50 is within the tolerance of 10 mm as the theoretical reference value (ACT 316). If the CPU 101 repeats, a predefined number of times, operation for checking whether the distance among the toner images of the respective colors of the adjustment patterns 50 is within the tolerance of 10 mm as the theoretical reference value in ACT 312 to ACT 316 (Yes in ACT 317), the CPU 101 updates the adjustment value stored in the memory 102 to the adjustment value for check (ACT 318). The CPU 101 finishes the initial alignment adjustment in the image quality priority print mode.

Figure 18:
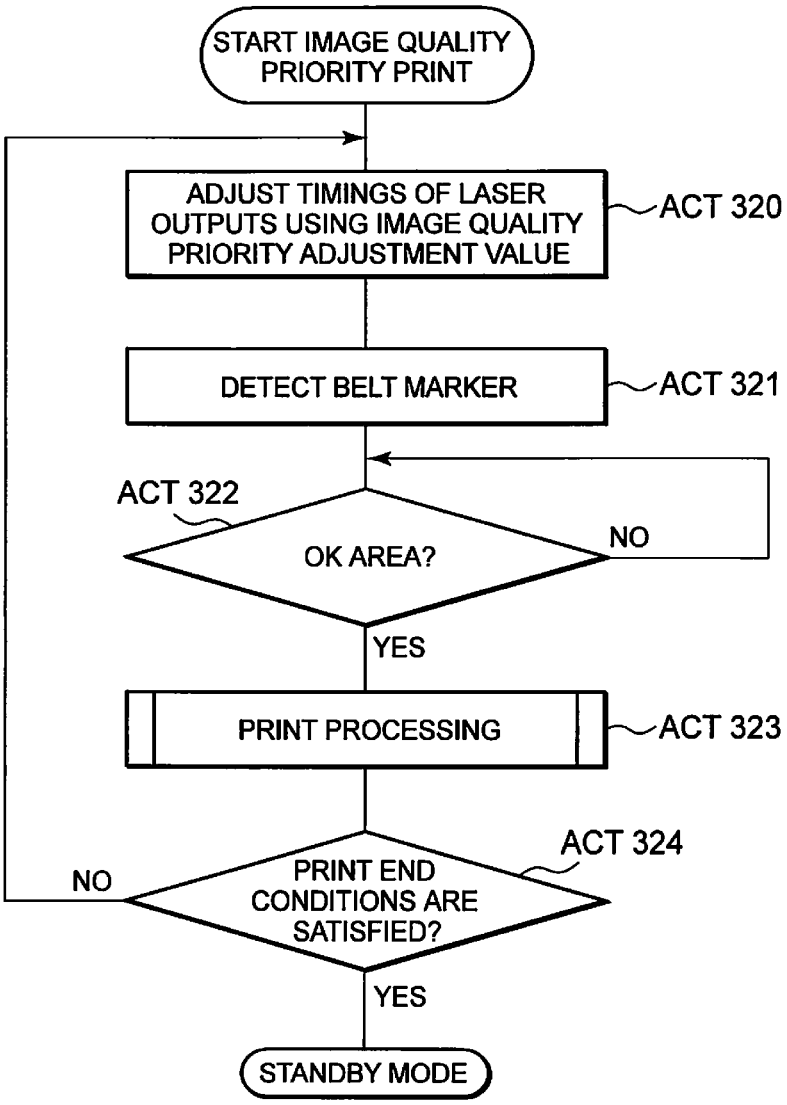
FIG. 18 is a flowchart for explaining an image quality priority print mode in the second embodiment.

When the color printer 1 finishes the initial alignment adjustment in the image quality priority print mode, the color printer 1 starts the image quality priority print mode shown in FIG. 18. In the image quality priority print mode, the color printer 1 performs image blur adjustment using the image quality priority adjustment value (H2) as an initial adjustment value. During the image quality priority print mode, the CPU 101 sets output timings of the laser oscillators 21K, 21C, 21M, and 21Y for the color components of black (K), cyan (C), magenta (M), and yellow (Y) according to the image quality priority adjustment value (H2) updated in ACT 318 (ACT 320).

The CPU 101 detects the belt marker 22 with the belt sensor 23 (ACT 321). The color printer 1 performs print processing to transfer image quality priority toner images onto a print OK area of the transfer belt 12 (Yes in ACT 322) (ACT 323). If a transfer area of the image quality priority toner images extends to the print NG area of the transfer belt 12 (the section from G1 to G4 of the transfer belt 12) (No in ACT 322), the color printer 1 stands by for the image quality priority print mode until the print NG area passes. The color printer 1 transfers, after the NG area of the transfer belt 12 passes, the image quality priority images onto the print OK area of the transfer belt 12 and performs the print processing (ACT 323). If image quality priority print finish conditions are not satisfied (No in ACT 324), the color printer 1 repeats ACT 320 to ACT 324. When the color printer 1 finishes the image quality priority image print (Yes in ACT 324), the color printer 1 stands by for the next operation.

If the operator selects print while the color printer 1 stands by for the next operation (Yes in ACT 240), the color printer 1 switches to the print mode in the speed priority print mode. If the operator selects the image quality priority print mode (Yes in ACT 241), the color printer 1 switches from the speed priority print mode to the image quality priority print mode.

During the image quality priority print mode, the CPU 101 more highly accurately sets output timings of the laser oscillators 21K, 21C, 21M, and 21Y for the respective color components according to the image quality priority adjustment value (H2). During the image quality priority print mode, the color printer 1 prints images avoiding the NG area of the transfer belt 12. In the image quality priority print mode, since the NG area of the transfer belt 12 is excluded from a print area, print speed falls. However, in the image quality priority print mode, a higher definition print image in which an image blur is less likely to occur can be obtained.

While in the speed priority print mode, when the color printer 1 obtains a print image using the entire circumference of the transfer belt 12, the color printer 1 may use the image quality priority adjustment value (H2) as the initial adjustment value. If the color printer 1 uses the image quality priority adjustment value (H2) as the initial adjustment value, the color printer 1 obtains a print image at high speed. Further, color printer 1 obtains a higher definition print image.

According to the second embodiment, in the initial alignment adjustment in the image quality priority print mode, the CPU 101 sets, as the NG pattern, the adjustment pattern having the largest difference between (adjustment value−1) and the distance data (an) among the eight sets of adjustment patterns imaged over the entire circumference of the transfer belt 12. The CPU 101 calculates an average of the remaining seven sets of adjustment patterns excluding the NG pattern and obtains the image quality priority adjustment value (H2). The CPU 101 adjusts output timings of the laser oscillators 21K, 21C, 21M, and 21Y according to the image quality priority adjustment value (H2). The color printer 1 obtains more highly accurate alignment adjustment.

According to the second embodiment, in the image quality priority print mode, the color printer 1 prints images avoiding the NG area G1 to G4 of the transfer belt 12 in which a blur is likely to occur. In the image quality priority print mode, the color printer 1 obtains a higher definition print image in which an image blur is less likely to occur.

According to the second embodiment, in the speed priority print mode, the CPU 101 averages all distance data of eight sets of adjustment patterns imaged over the entire circumference of the transfer belt 12 and obtains the speed priority adjustment value (H1). In the speed priority print mode, the color printer 1 prints images using the entire circumference of the transfer belt 12. In the speed priority print mode, the color printer 1 obtains a print image at high speed.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and there equivalents are intended to cover such forms of modifications as would fall within the scope and spirit of the invention.

What is claimed is:

1. An image alignment adjusting apparatus comprising:
an endless traveling belt;
a pattern sensor configured to detect an adjustment pattern including plural colors imaged on the traveling belt; and
a correcting unit configured to use, in initial adjustment, for image alignment adjustment by an image forming unit configured to image the adjustment pattern, an initial adjustment value obtained by detecting, with the pattern sensor, a plurality of sets of the adjustment pattern imaged over an entire circumference of the traveling belt and use, in intermediate adjustment, for the image alignment adjustment by the image forming unit, an intermediate adjustment value obtained by correcting the initial adjustment value using an intermediate detection value obtained by detecting, with the pattern sensor, one set of the adjustment pattern imaged on the traveling belt.

2. The apparatus according to claim 1, wherein the initial adjustment value is an average of distance data of the plurality of sets of the adjustment pattern.

3. The apparatus according to claim 1, wherein
the intermediate detection value is intermediate distance data of the one set of the adjustment pattern, and
the intermediate adjustment value is a value obtained by adding a difference between the intermediate distance data of the one set of the adjustment pattern and distance data of the plurality of sets of the adjustment pattern imaged in a same area of the traveling belt to the initial adjustment value.

4. The apparatus according to claim 1, further comprising:
a belt marker provided on the traveling belt; and
a belt sensor configured to detect the belt marker, wherein
the apparatus images, in the initial adjustment, the plurality of sets of the adjustment pattern over the entire circumference of the traveling belt with the belt marker as a start point and images, in the intermediate adjustment, the one set of the adjustment pattern on the traveling belt with the belt marker as a start point.

5. The apparatus according to claim 1, further comprising:
a belt marker provided on the traveling belt; and
a belt sensor configured to detect the belt marker, wherein
the one set of the adjustment pattern imaged on the traveling belt during the intermediate adjustment is present in a same position as a position of a first pattern imaged first after the belt sensor detects the belt marker during the initial adjustment.

6. The apparatus according to claim 1, further comprising:
a belt marker provided on the traveling belt; and
a belt sensor configured to detect the belt marker, wherein
the one set of the adjustment pattern imaged on the traveling belt during the intermediate adjustment is an intermediate pattern imaged first after the belt sensor detects the belt marker and after print image formation on the traveling belt finishes during the initial adjustment.

7. The apparatus according to claim 1, wherein
the initial adjustment includes speed priority adjustment and image quality priority adjustment,
in the speed priority adjustment, the initial adjustment value is a speed priority adjustment value obtained by averaging all distance data of the plurality of sets of the adjustment pattern, and
in the image quality priority adjustment, the initial adjustment value is an image quality priority adjustment value obtained by averaging all the distance data of the plurality sets of the adjustment pattern excluding an abnormal value.

8. The apparatus according to claim 1, wherein
the initial adjustment includes speed priority adjustment and image quality priority adjustment, and
in the image quality priority adjustment, the traveling belt has an image formation inhibited area.

9. An image forming apparatus comprising:
an endless traveling belt;
plural image forming units configured to image an adjustment pattern including plural colors on the traveling belt during alignment adjustment;
a pattern sensor configured to detect the adjustment pattern imaged on the traveling belt; and
a correcting unit configured to use, in initial adjustment, for image alignment adjustment by the image forming units configured to image the adjustment pattern, an initial adjustment value obtained by detecting, with the pattern sensor, a plurality of sets of the adjustment pattern imaged over an entire circumference of the traveling belt and use, in intermediate adjustment, for the image alignment adjustment by the image forming units, an intermediate adjustment value obtained by correcting the initial adjustment value using an intermediate detection value obtained by detecting, with the pattern sensor, one set of the adjustment pattern imaged on the traveling belt.

10. The apparatus according to claim 9, wherein the initial adjustment value is an average of distance data of the plurality of sets of the adjustment pattern.

11. The apparatus according to claim 9, wherein
the intermediate detection value is intermediate distance data of the one set of the adjustment pattern, and
the intermediate adjustment value is a value obtained by adding a difference between the intermediate distance data of the one set of the adjustment pattern and the distance data of the plurality of sets of the adjustment pattern imaged in a same area of the traveling belt to the initial adjustment value.

12. The apparatus according to claim 9, further comprising:
a belt marker provided on the traveling belt; and
a belt sensor configured to detect the belt marker, wherein
the image forming units image, in the initial adjustment, the plurality of sets of the adjustment pattern over the entire circumference of the traveling belt with the belt marker as a start point and image, in the intermediate adjustment, the one set of the adjustment pattern on the traveling belt with the belt marker as a start point.

13. The apparatus according to claim 9, further comprising:
a belt marker provided on the traveling belt; and
a belt sensor configured to detect the belt marker, wherein
the one set of the adjustment pattern imaged on the traveling belt during the intermediate adjustment is present in a same position as a position of a first pattern imaged first after the belt sensor detects the belt marker during the initial adjustment.

14. The apparatus according to claim 9, further comprising:
a belt marker provided on the traveling belt; and
a belt sensor configured to detect the belt marker, wherein
the one set of the adjustment pattern imaged on the traveling belt during the intermediate adjustment is an intermediate pattern imaged first after the belt sensor detects the belt marker and after print image formation on the traveling belt finishes during the initial adjustment.

15. The apparatus according to claim 9, wherein
the initial adjustment includes speed priority adjustment and image quality priority adjustment,
in the speed priority adjustment, the initial adjustment value is a speed priority adjustment value obtained by averaging all distance data of the plurality of sets of the adjustment pattern, and
in the image quality priority adjustment, the initial adjustment value is an image quality priority adjustment value obtained by averaging all the distance data of the plurality of sets of the adjustment pattern excluding an abnormal value.

16. The apparatus according to claim 9, wherein
the initial adjustment includes speed priority adjustment and image quality priority adjustment, and
in the image quality priority adjustment, the traveling belt has an image formation inhibited area, and the image forming units do not form an image in the image formation inhibited area of the traveling belt.

17. An image aligning method comprising:
imaging plural sets of adjustment patterns each including plural colors over an entire circumference of a traveling belt;
detecting the plural sets of the adjustment patterns imaged on the traveling belt;
obtaining an initial adjustment value from a detection result of the plural sets of the adjustment patterns;
using the initial adjustment value for image alignment adjustment;
imaging one set of the adjustment patterns on the traveling belt;
detecting the one set of the adjustment patterns imaged on the traveling belt;
correcting the initial adjustment value using an intermediate detection value obtained from a detection result of the one set of the adjustment patterns and obtaining an intermediate adjustment value; and
using the intermediate adjustment value for the image alignment adjustment.

18. The method according to claim 17, wherein the initial adjustment value is an average of distance data detected from the plural sets of the adjustment patterns.

19. The method according to claim 17, wherein
the intermediate detection value is intermediate distance data of the one set of the adjustment patterns, and
the intermediate adjustment value is a value obtained by adding a difference between the intermediate distance data of the one set of the adjustment patterns and distance data of the plural sets of the adjustment pattern imaged in a same area of the traveling belt to the initial adjustment value.

20. The method according to claim 17, wherein
the initial adjustment value includes a speed priority adjustment value and an image quality priority adjustment value,
the speed priority adjustment value is obtained by averaging all distance data of the plural sets of the adjustment patterns, and
the image quality priority adjustment value is obtained by averaging all the distance data of the plural sets of the adjustment patterns excluding an abnormal value.

21. The method according to claim 20, further comprising setting an image formation inhibited area on the traveling belt during image formation using the image quality priority adjustment value.

* * * * *